US006895194B2

(12) United States Patent
Mo et al.

(10) Patent No.: US 6,895,194 B2
(45) Date of Patent: May 17, 2005

(54) XEROGRAPHIC DEVELOPMENT SYSTEM WHERE A GAP BETWEEN A DONOR MEMBER AND A PHOTORECEPTOR IS ESTIMATED

(75) Inventors: Song-feng Mo, Webster, NY (US); Wendy K. Apton, Rochester, NY (US); Stephen F. Randall, Eden, NY (US); Patrick J. Walker, Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/650,861

(22) Filed: Aug. 28, 2003

(65) Prior Publication Data

US 2005/0047806 A1 Mar. 3, 2005

(51) Int. Cl.[7] ..... G03G 15/08
(52) U.S. Cl. ..... 399/31; 399/49; 399/53
(58) Field of Search ..... 399/49, 72, 289, 399/285, 270, 53, 31

(56) References Cited

U.S. PATENT DOCUMENTS 4,318,610 A * 3/1982 Grace ..... 399/49
4,662,311 A * 5/1987 Shoji et al. ..... 399/270
5,424,812 A * 6/1995 Kemmochi et al. ..... 399/270
5,463,452 A * 10/1995 Inaba et al. ..... 399/270
6,266,494 B1 7/2001 Budnik et al. ..... 399/55
6,285,837 B1 * 9/2001 Budnik et al.
6,445,889 B1 9/2002 Leclerc et al. ..... 399/53
2004/0071477 A1 * 4/2004 Do ..... 399/53

FOREIGN PATENT DOCUMENTS

JP 05289490 A * 11/1993 ..... G03G/15/08

* cited by examiner

*Primary Examiner*—Susan Lee
(74) *Attorney, Agent, or Firm*—R. Hutter

(57) ABSTRACT

In a hybrid jumping (HJD) or hybrid scavengeless (HSD) development station used in xerography, a control system avoids arcing conditions in a gap between a donor member and an image receptor. In a set-up operation, a series of test patches are produced while incrementing the AC amplitude in the gap. A change in reflectivity of the patches as a function of the AC amplitude in the gap is measured and the actual width of the gap is thus estimated. An accurate estimate of the gap width can then be used in a control algorithm.

12 Claims, 2 Drawing Sheets

XEROGRAPHIC DEVELOPMENT SYSTEM WHERE A GAP BETWEEN A DONOR MEMBER AND A PHOTORECEPTOR IS ESTIMATED

INCORPORATION BY REFERENCE

The following U.S. patent, assigned to the assignee hereof, is hereby incorporated by reference: U.S. Pat. No. 6,285,837.

TECHNICAL FIELD

This disclosure relates generally to a development system as used in xerography, and more particularly concerns a "jumping" development system in which toner is conveyed to an electrostatic latent image on an image receptor by an AC field.

BACKGROUND

In a typical electrostatographic printing process, such as xerography, an image receptor such as a photoreceptor is charged to a substantially uniform potential so as to sensitize the surface thereof. The charged portion of the photoreceptor is exposed to a light image of an original document being reproduced. Exposure of the charged photoreceptor selectively dissipates the charges thereon in the irradiated areas. This records an electrostatic latent image on the photoreceptor corresponding to the informational areas contained within the original document. After the electrostatic latent image is recorded on the photoreceptor, the latent image is developed by bringing a developer material into contact therewith. Generally, the developer material comprises toner particles adhering triboelectrically to carrier granules. The toner particles are attracted from the carrier granules to the latent image forming a toner powder image on the photoreceptor. The toner powder image is then transferred from the photoreceptor to a copy sheet. The toner particles are heated to permanently affix the powder image to the copy sheet. After each transfer process, the toner remaining on the photoconductor is cleaned by a cleaning device.

One specific type of development apparatus currently used in high-quality xerography is known as a hybrid jumping development (HJD) system. In the HJD system, a layer of toner is laid down evenly on the surface of a "donor roll" which is disposed near the surface of the photoreceptor. Biases placed on the donor roll create two development fields, or potentials, across the gap between the donor roll and the photoreceptor. The action of these fields causes toner particles on the donor roll surface to form a "toner cloud" in the gap, and the toner in this cloud thus becomes available to attach to appropriately charged image areas on the photoreceptor.

In a practical application of hybrid jumping development, a crucial parameter for the quality of the resulting images is the width of the gap between of the donor roll and the photoreceptor. If the width of the gap is too large, noticeable defects in image quality will result. If the gap is too small, there is likely to be arcing between the donor roll and the photoreceptor, which is of course unacceptable. Unfortunately, with the desirable modular design of office equipment, this crucial gap width is hard to control if the module including the donor roll is separate from another module including the photoreceptor. Whenever one or the other module is replaced, the gap width is likely to change. It is therefore desirable to have a testing method, which can be automated by software within the printer, which can accurately estimate the gap width at any time.

PRIOR ART

U.S. Pat. No. 6,266,494 discloses a control system for HJD xerography, in which a variable relating to the altitude of the apparatus is entered at system set-up. The altitude number can be used in algorithms to detect arcing conditions.

U.S. Pat. No. 6,285,837 discloses a control system for HJD xerography, in which each of a set of variables are systematically altered to calculate arcing conditions.

U.S. Pat. No. 6,445,889 discloses a control system for HJD xerography, in which duty cycles for the xerographic process are systematically altered to avoid arcing conditions.

SUMMARY

According to one aspect, there is provided a method of operating an electrostatographic apparatus, the apparatus including an image receptor and a donor member. An AC field is established in a gap between the image receptor and the donor member. At least one test patch is created for each of a plurality of AC field conditions. A value associated with the at least one test patch is read for each of the plurality of AC field conditions, thereby yielding a plurality of data points forming a function. The function is analyzed to estimate a size of the gap.

DETAILED DESCRIPTION

Figure 1:
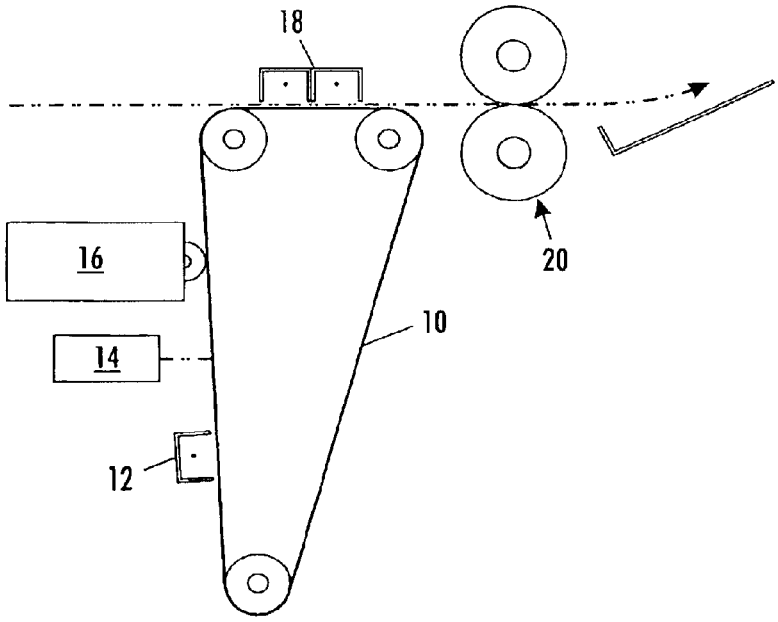
FIG. 1 PRIOR ART
FIG. 1 is a simplified elevational view of an electrostatographic printing apparatus.

FIG. 1 is a simplified elevational view of an electrostatographic, in this instance xerographic, printing apparatus, as known in the Prior Art. An image receptor, here in the form of belt photoreceptor 10, is entrained around several rollers. At one point along the path of rotation of photoreceptor 10, the surface thereof is evenly charged by a corotron 12. Laser 14 is then used to selectively discharge areas of the photoreceptor 10 to form a desired latent image. The latent image is then developed at development station 16, the details of which will be described below, where toner particles are caused to be attracted to the suitably-charged portions of the latent image. At transfer station 18, the toner particles, in imagewise form, are transferred to a print sheet. The print sheet bearing the toner particles is then passed to fusing apparatus 20, where the toner particles are fused permanently to the sheet using heat and pressure.

Figure 2:
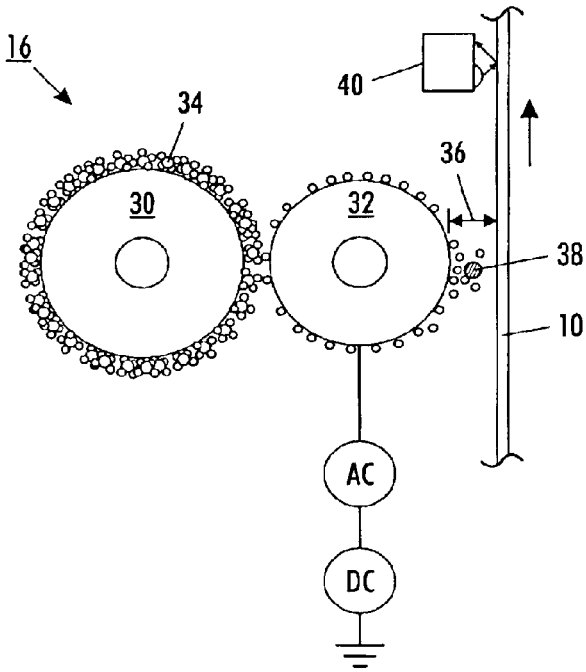
FIG. 2 is an elevational view of a xerographic development station.

FIG. 2 is an elevational view of a development station 16. (The basic hardware shown in FIG. 2 is known in the Prior Art.) The overall function of the development station is to convey toner particles to the surface of photoreceptor 10, so that the toner particles are caused to attach to the suitably-charged (such as print-black) portions of the latent image, thus "developing" the image. In this embodiment, there is provided a magnetic roll 30, and at least one donor roll 32. Magnetic roll 30 typically comprises an outer cylindrical sleeve which rotates about a stationarily-mounted set of magnets (not shown). Two-component developer material, comprising toner particles which are triboelectrically attached to magnetically-attractable carrier particles, is drawn from a supply (not shown) and held to the rotating sleeve of magnetic roll 30 by the magnetic attraction of the stationary magnets, forming a "magnetic brush" 34 generally familiar in xerography.

The magnetic brush 34 is then used to contribute toner particles to the surface of rotating donor roll 32. As shown, donor roll 32 is biased with at least an AC bias, although a DC bias may be included as well. (Other elements in the development station 16 may be AC or DC biased as needed, as described for example in the patent incorporated by reference above.) The various biases cause toner particles to be drawn from magnetic brush 34 onto donor roll 32, and then, as donor roll 32 rotates, become available for developing a latent image on photoreceptor 10. In order to convey toner from donor roll 32 to photoreceptor 10, there must be created an AC field between donor roll 32 and photoreceptor 10.

(Also shown in FIG. 2 is a cross-section of a wire 38 disposed in gap 36. This wire 38 can be AC biased to create an AC field in gap 36, in a "hybrid scavengeless" or HSD system; if no wire 38 is present, the AC field in gap 36 is largely created by an AC bias on donor roll 32, and such an arrangement is often known as a "hybrid jumping" or HJD system.)

As described above, with these types of development, a practical danger involves arcing in the gap 36 between donor roll 32 and photoreceptor 10. The likelihood of arcing can vary as a result of high potentials, altitude, humidity, etc. The various patents referenced above are each concerned with avoiding arcing conditions. In these prior-art patents, arcing conditions are detected by various self-tests, and the operation of the system is altered as needed to avoid arcing. In these prior-art cases, the actual width of the gap, which is of course very significant in determining the likelihood of arcing at any time, is typically assumed. In the present embodiment, certain techniques are employed to reasonably accurately estimate the width of gap 36, and this estimated gap width can then be used in an anti-arcing control system. An accurate estimate of the actual gap width in turn enables use of a more precise anti-arcing algorithm.

As shown in FIG. 2, downstream of the development station 16 is a reflectivity sensor 40, which is capable of measuring the actual reflectivity of a test patch of a predetermined target density created by the development station 16, in a manner generally familiar in the art. According to the embodiment, at a xerographic set-up time, the printing apparatus is caused to print (on the photoreceptor 10) a series of test patches, each of a predetermined target density. With each of the series of test patches, all other potentials and other variables are held constant, but one aspect or parameter of the field is changed or incremented. In one practical embodiment, the AC bias in the field across gap 36, or more specifically the amplitude of the AC component of the field, is incremented with each test patch: for example, with each test patch the AC bias is increased by 50 volts from 1600 volts to 2400 volts. After each test patch is printed, the actual reflectivity of the patch (as opposed to the intended target reflectivity) is measured with the reflectivity sensor 40. A series of data points results.

Figure 3:
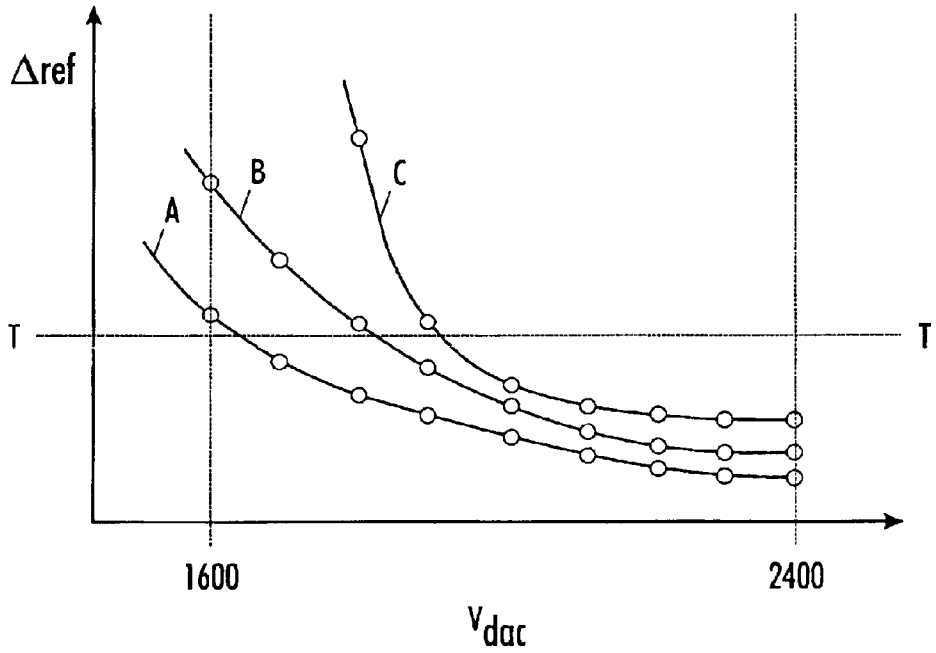
FIG. 3 is a graph relevant to the discussion of the development station of FIG. 2.

The collected data points are in turn used to derive a function which can be analyzed. FIG. 3 shows a graph of three functions, of a given type, which can be derived from the above-described method. In the graph the x-axis represents the AC amplitude of the field, also called $V_{dac}$, here in regular increments from 1600 volts to 2400 volts; the y-axis represents the change in reflectivity of the actual, measured test patch from one incremented AC bias to the next: in other words, the function in FIG. 3 represents the change in reflectivity ($\Delta_{ref}$) as a function of $V_{dac}$.

As can be seen in FIG. 3, which shows three fairly typical curves one would obtain from an actual apparatus, the actual width of gap 36 has a noticeable effect on the function: in short: the wider the gap 36, the more pronounced is the curve of the function. A small gap saturates across a wide range of potentials, such as shown in sample curve A, while a larger gap shows larger changes in test patch reflectivity through the increments, such as shown by sample curves B or C. From these functions, the actual width of gap 36 can thus be accurately estimated. One simple mathematical way to obtain this estimate is to determine where the function intercepts a predetermined threshold (such as marked as T) on the y-axis: roughly speaking, the wider the gap 36, the less flat the function, and the higher the x-value of the intercept. There can be a linear function or a non-linear look-up table which relates the threshold intercept to the width of gap 36. Alternatively, more sophisticated mathematical methods, such as curve-fitting, can be used to relate the function to the width of gap 36.

In one embodiment, for each AC bias iteration of the field, three test patches, each of a predetermined target density, are caused to be printed. Typical target densities are 15%, 50% and 85%; these densities are typically formed by halftone screens created by the laser 14. The three target test patches for each AC bias are measured and the actual reflectivities thereof eventually averaged to obtain in effect a single actual reflectivity or $\Delta_{ref}$ value for the particular $V_{dac}$.

Although the test patches are here shown as being measured with a reflectivity sensor 40, it is conceivable to measure the test patches by other means, such as with an electrostatic voltmeter.

Although the development station 16 is here shown with one donor roll 32, it is known to provide a development station with two donor rolls associated with a single magnetic roll.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of operating an electrostatographic apparatus, the apparatus including an image receptor and a donor member, comprising:

establishing an AC field in a gap between the image receptor and the donor member;

creating at least one test patch for each of a plurality of AC field conditions;

reading a value associated with the at least one test patch for each of the plurality of AC field conditions, thereby yielding a plurality of data points forming a function; and analyzing the function to estimate a size of the gap, and relating the estimated size of the gap to a value suitable for entry into a control system.

2. The method of claim 1, wherein each AC field condition is characterized by an AC amplitude.

3. The method of claim 1, the creating step including creating a plurality of test patches for each AC field condition.

4. The method of claim 3, wherein each of the plurality of test patches for each AC field condition is of a different target density.

5. The method of claim 1, the reading step including measuring a reflectivity of the at least one test patch.

6. The method of claim 1, the reading step including measuring a reflectivity of a plurality of test patches for each AC field condition.

7. The method of claim 6, the reading step including averaging the measured reflectivities of a plurality of test patches for each AC field condition.

8. The method of claim 1, the function being related to a reflectivity of a test patch as a function of the field condition.

9. The method of claim 8, the function being related to a change in reflectivity of a test patch as a function of a change in the field condition.

10. The method of claim 1, the analyzing step including determining an intercept point of the function relative to a predetermined threshold.

11. The method of claim 1, the analyzing step including performing a curve fit associated with the function.

12. The method of claim 1, further comprising:

entering an estimated size of the gap into a control system the control system being related to an arcing condition.

* * * * *